US005794409A

United States Patent [19]

Akridge et al.

[11] Patent Number: 5,794,409

[45] Date of Patent: Aug. 18, 1998

[54] METHOD OF PROCESSING AND STUFFING AN ENVELOPE

[75] Inventors: Walter M. Akridge, Dayton; David E. Washburn; John A. Moore, Jr., both of Kettering, all of Ohio

[73] Assignee: The Standard Register Company, Dayton, Ohio

[21] Appl. No.: 657,631

[22] Filed: May 30, 1996

Related U.S. Application Data

[62] Division of Ser. No. 414,935, Mar. 31, 1995.

[51] Int. Cl.[6] ..... B65B 11/48; B65B 61/02

[52] U.S. Cl. ..... 53/460; 53/131.4; 53/411; 53/569; 493/216

[58] Field of Search ..... 53/460, 411, 569, 53/206, 131.4, 131.2; 493/216, 188

[56] References Cited

U.S. PATENT DOCUMENTS

| | | | |
|---|---|---|---|
| Re. 25,961 | 2/1966 | Volks et al. . | |
| 442,842 | 12/1890 | West . | |
| 768,670 | 8/1904 | Martin . | |
| 886,350 | 5/1908 | Corliss . | |
| 1,108,540 | 8/1914 | Ahlquist . | |
| 2,014,914 | 9/1935 | Teicher . | |
| 2,087,362 | 7/1937 | Swift . | |
| 3,358,903 | 12/1967 | DeStefano et al. | 383/122 X |
| 3,860,164 | 1/1975 | Dworkin . | |
| 3,897,720 | 8/1975 | Hiersteiner | 53/460 X |
| 4,294,400 | 10/1981 | Gendron . | |
| 4,332,346 | 6/1982 | Kronman . | |
| 4,411,643 | 10/1983 | Higginson | 493/216 X |
| 4,487,360 | 12/1984 | Fisher et al. . | |
| 4,492,308 | 1/1985 | Meeker et al. | 206/610 |
| 4,530,731 | 7/1985 | Bradley | 493/216 X |
| 4,579,277 | 4/1986 | Gendron . | |
| 4,595,138 | 6/1986 | Kristel . | |
| 4,597,591 | 7/1986 | Gendron et al. . | |
| 4,602,736 | 7/1986 | Barr . | |
| 4,630,768 | 12/1986 | Bradley | 493/216 X |
| 4,688,715 | 8/1987 | Barr | 493/188 X |
| 4,729,507 | 3/1988 | Kim | 206/610 |
| 4,731,048 | 3/1988 | Marella et al. | 493/188 |
| 4,899,926 | 2/1990 | Spaulding . | |
| 5,052,613 | 10/1991 | Lin . | |
| 5,067,305 | 11/1991 | Baker et al. | 53/460 X |
| 5,197,663 | 3/1993 | Stude | 229/303 |
| 5,224,647 | 7/1993 | Yanow | 229/302 |
| 5,251,810 | 10/1993 | Kim | 229/303 |
| 5,267,687 | 12/1993 | Sherman | 229/305 |
| 5,427,851 | 6/1995 | Mehta | 428/356 |
| 5,444,961 | 8/1995 | Doane et al. | 53/411 |
| 5,555,703 | 9/1996 | Gombault et al. | 53/411 |

*Primary Examiner*—James F. Coan

*Attorney, Agent, or Firm*—Killworth, Gottman, Hagan & Schaeff, L.L.P.

[57] ABSTRACT

The present invention is an envelope sheet capable of being automatically printed and formed into a standard business envelope using a high-speed separate sheet printer in line with high-speed separate sheet folding and pressure sealing equipment. The present envelope sheet comprises a front panel connected to a back panel along a bottom fold line, to a closing flap along a top fold line, to a left-side flap along a left-side fold line and to a right-side flat along a right-side fold line. The front panel, back panel, closing flap and both side flaps each have an upper surface and a lower surface. The back panel is adhered to the left-side and right-side flaps with a latent adhesive sandwiched therebetween. The present invention also includes a method and apparatus for automatically printing and forming an envelope from the present envelope sheet, as well as automatically stuffing the envelope while it is being formed.

14 Claims, 4 Drawing Sheets

METHOD OF PROCESSING AND STUFFING AN ENVELOPE

RELATED APPLICATION

This application is a divisional application of U.S. patent application Ser. No. 08/414,935, filed Mar. 31, 1995 and entitled ENVELOPE SHEET AND METHOD OF PROCESSING, which is assigned to the assignee of the present application.

FIELD OF THE INVENTION

The present invention is related to envelope forms and automatic envelope forming equipment, more particularly to an envelope sheet capable of being printed with a high-speed separate sheet printer and then formed into an envelope using high-speed separate sheet folding and pressure sealing equipment, and even more particularly to such an envelope sheet capable of being automatically stuffed with an insert as it is being formed.

BACKGROUND OF THE INVENTION

Mass mailings are often used to reach large groups of people for wide ranging purposes including marketing and advertising products and services; charitable, political and other types of solicitations; and health, safety and other types of notices. Even with the advent of mass market telecommunication systems, mass mailings have remained an attractive alternative for communicating with large groups. For mass mailings to remain a viable alternative to telecommunication systems the costs associated with mass mailings must remain competitive. Mass mailings typically involve printing the name and address of each member of the targeted group on an individual envelope, stuffing an insert in each envelope, sealing the envelope, and then mailing the stuffed envelope to the addressee. As such, mass mailings are relatively labor intensive and time consuming. Therefore, the more automated mass mailings can become, the more likely the costs of mass mailings will remain competitive.

The effectiveness of a mass mailing is dependent upon a large number of the recipients opening the envelopes and reviewing the contents. If an envelope gives the appearance of a mass mailing, the recipient is more likely to throw the envelope away unopened. However, if the envelope appears to be a standard business envelope, the recipient may be more inclined to review its contents before making a decision as to its final disposition.

A standard business envelope has a front panel with a back panel, opposite side flaps and a closing flap extending therefrom. The envelope is formed by adhering the back panel with the two side flaps. The closing flap is left open until the envelope is stuffed with an insert, and then it is sealed closed, usually with a strip of remoist adhesive. With a typical "junk mail" envelope, a sheet insert is typically sandwiched between a front and a back panel that are sealed together along adjoining edges. One problem with using present standard business envelopes in mass mailing applications is that they are not as cost effective to prepare for mailing as the "junk mail" appearing envelopes.

There is, therefore, a need for an envelope capable of being automatically printed and stuffed with an insert in a low cost manner, while having the appearance of a standard business envelope.

SUMMARY OF THE INVENTION

Accordingly, it is an objective of the present invention to provide an envelope which can reduce the labor and time associated with mass mailings to large groups.

An additional objective is to provide such an envelope that has the appearance of a standard business envelope.

Another objective of the present invention is to provide an envelope sheet capable of being automatically printed and formed into a standard business envelope.

A related objective of the present invention is to provide such an envelope sheet capable of being printed with a high-speed separate sheet printer and then formed into a standard business envelope using high-speed separate sheet folding and pressure sealing equipment.

Still another objective of the present invention is to eliminate the need for a secondary envelope stuffing operation.

Yet another objective of the present invention is to provide an envelope sheet capable of being automatically printed, formed into a standard business envelope and stuffed with an insert while being formed into the envelope.

A further objective of the present invention is to provide a method and apparatus for automatically stuffing an envelope while the envelope is being formed.

The above and other objectives of the present invention are obtained by providing an envelope sheet comprising a front panel connected to a back panel along a bottom fold line, to a closing flap along a top fold line, to a first left-side flap along a first left-side fold line and to a first right-side flap along a first right-side fold line. The front panel, back panel, closing flap and both side flaps each have an upper surface and a lower surface. The back panel has a bottom edge and two opposite side edges. A plurality of adhesive areas are disposed on the envelope sheet. An adhesive area is herein defined as one area of the present envelope sheet that will overlap and be adhered to another adhesive area, when the envelope sheet is formed into an envelope. At least one latent adhesive is adhered in a pattern to each of a plurality of adhesive areas so as to be sandwiched between each overlapping pair of adhesive areas, when the present envelope sheet is formed into an envelope. As used herein, a latent adhesive is an adhesive which can remain inactive until sandwiched between two overlapping adhesive areas and which can be activated once so disposed. A self-sticking adhesive (i.e., one that only adhesively bonds to itself or another self-sticking adhesive) is an example of a latent adhesive. However, the self-sticking adhesive must be applied to the surface of each adhesive area in order to obtain an adhesive-to-adhesive bond. Other suitable latent adhesives can include a heat seal (i.e., temperature activated) type and an encapsulated adhesive. Either of these last two types of latent adhesives can be applied to only one of each pair of overlapping adhesive areas. Though, it may be desirable to apply such a latent adhesive to both overlapping adhesive areas.

In one embodiment of the present envelope sheet, an adhesive area is disposed on the upper surface of its back panel adjacent to each of its first side edges. In addition, the first left-side flap and the first right-side flap each have an adhesive area on its lower surface. The adhesive area disposed on the lower surface of each first side flap is positioned so as to overlap the adhesive area located adjacent the corresponding side edge of the back panel, when the first side flaps are folded over onto the upper surface of the front panel, and when the back panel is then folded over to be adjacent the upper surface of each side flap.

In an alternative embodiment of the present invention, the envelope sheet further comprises a second left-side flap and a second right-side flap, one on either side of the back panel along a corresponding side fold line. The two left-side flaps are connected along an adjoining side bottom fold line. The two right-side flaps are also connected along another adjoining side bottom fold line. Each side flap has an upper and lower surface. An adhesive area is disposed on the lower surface of each first and second side flap. In a modification to this embodiment, an adhesive area is disposed on the upper surface of each second side flap and on the upper surface of the back panel adjacent to each of its first side edges.

The present envelope sheet is operatively adapted to be printed with a high-speed separate sheet printer and then formed into an envelope using high-speed separate sheet folding and pressure sealing equipment. In order to maintain the envelope sheet in a stable orientation as it travels through the printer, it may be desirable for the envelope sheet to have substantially the same side-to-side width along a substantial portion of its length. Such an envelope sheet is less likely to misalign when printed because its shape more closely approximates that of standard sheet used in such printers. Therefore, in one feature of the above described alternative envelope sheet embodiment, the first and second side flaps are adapted to give the envelope sheet substantially the same side-to-side width across the front panel as across the back panel.

The structure of the present envelope sheet enables it to be automatically formed into an envelope using high-speed separate sheet folding and sealing equipment, where the corresponding side flaps are folded over onto the front panel, and in the case of the second embodiment, the back panel, and the back panel is automatically folded over onto the front panel. The envelope sheet is preferably printed in its flat condition, before this folding operation. Next, each pattern of latent adhesive is activated. For example, with a self-sticking or encapsulated adhesive, a sealing pressure is automatically applied to the now folded envelope sheet, at least where latent adhesive patterns are sandwiched therebetween.

The structure of the present envelope sheet and this forming operation lends itself to stuffing the resulting envelope automatically as it is being formed. The need for a secondary envelope stuffing operation may be avoided by interfacing several sheet feeders in the printer to print each envelope sheet and sheet insert separately, collate them, fold the envelope sheet into a folded but unsealed envelope around the sheet insert and seal the folded envelope closed with the insert inside, all in one operation. Before the folding of the envelope sheet begins and preferably after the envelope sheet has been printed, the sheet insert is automatically disposed on top of the envelope sheet. The sheet insert may be separately printed or printed with the same printer used to print the envelope sheet and then collated, one on top of the other. The sheet insert is effectively smaller in area than the envelope sheet when it is disposed thereon. That is, the sheet insert may be smaller in size or prefolded in order to lie within the envelope sheet. The sheet insert is positioned on the envelope sheet so as to be sandwiched between the back and front panel at the end of the envelope forming operation.

The closing flap of the present envelope sheet may be left opened at the end of the envelope forming operation and sealed closed thereafter. Alternatively, the closing flap may be folded and sealed closed at the same time that the envelope is being formed. When the envelope is being automatically stuffed with the sheet insert, either envelope closing operation may be used, though the automatic closing step is preferred. The closing flap may be sealed closed with a pattern of standard remoist adhesive fixed to its upper surface along its top edge. Alternatively, one or more patterns of a latent adhesive may be used. For example, a pattern of a self-sticking adhesive may be applied to an adhesive area on the upper surface of the closing flap along its top edge and another pattern of a self-sticking adhesive applied to the lower surface of the back panel along its bottom edge. These self-sticking adhesive patterns are disposed so as to make contact with each other when the envelope is formed and the closing flap closed.

The above and other objectives, features, and advantages of the present invention will become apparent upon consideration of the detailed description and the appended drawings.

DETAILED DESCRIPTION OF THE INVENTION

Although the present invention is herein described in terms of specific embodiments, it will be readily apparent to those skilled in this art that various modifications, re-arrangements, and substitutions can be made without departing from the spirit of the invention. For example, each of the exemplary envelope sheet embodiments described in detail below and shown in the appended drawings is constructed so as to form an envelope that is similar in appearance to a standard #10 business envelope. However, the present invention is not intended to be so limited. The scope of the present invention is only to be limited by the claims appended hereto.

Figure 1:
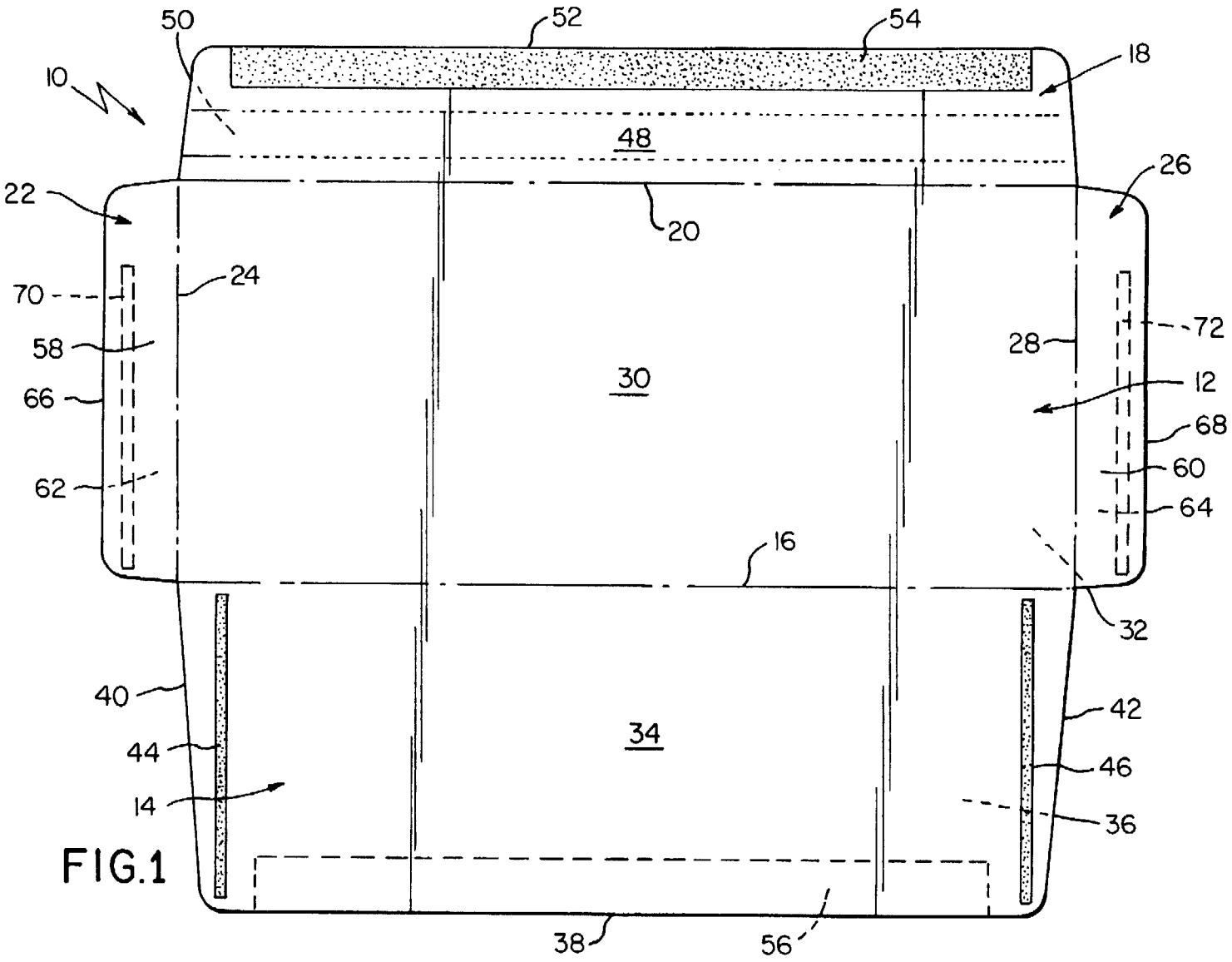
FIG. 1 is a top plan view of one embodiment of the present envelope sheet.

Referring to FIG. 1, one embodiment of an envelope sheet 10 according to the principles of the present invention includes a front panel 12 connected to a back panel 14 along a bottom fold line 16. The front panel 12 is connected to a closing flap 18 along a top fold line 20, to a first left-side flap 22 along a first left-side fold line 24, and to a first right-side flap 26 along a first right-side fold line 28. Each fold line 16, 20, 24 and 28 can be perforated, creased or otherwise adapted to ensure folding therealong.

The front panel 12 has a first upper surface 30 and a first lower surface 32 and may also include a window patch area covered by a clear film patch or transparent paper (not shown). The back panel 14 has a second upper surface 34, a second lower surface 36, a bottom edge 38 and two opposite side edges 40 and 42. Two adhesive areas 44 and 46 are located on the upper surface 34 of back panel 14, with each adhesive area 44 and 46 being respectively disposed adjacent one of the side edges 40 and 42. Each area 44 and 46 is covered with a pattern of a latent adhesive. By way of example only, the adhesive used for each area 44 and 46 is a self-sticking adhesive. Other latent adhesives, such as a heat seal (i.e., temperature activated) type and an encapsulated adhesive, can also be used. Heat seal type adhesives are well known and need not be disclosed in detail herein. Encapsulated adhesives are taught in U.S. Pat. Nos. 2,907,682 and 2,986,477, which are incorporated by reference herein.

A self-sticking adhesive is one that only adhesively bonds to itself. That is, opposing self-sticking adhesive patterns will only seal together when they come in contact, and then only when placed under significant pressure. Numerous self-sticking adhesives are known. One suitable self-sticking adhesive is disclosed in a co-pending U.S. patent application Ser. No. 08/197,639, filed Feb. 19, 1994, and entitled PRESSURE BONDING ADHESIVE AND ADHESIVE COATED PRODUCT, and incorporated herein by reference. Other self-sticking adhesives are disclosed in U.S. Pat. Nos. 4,918,128 and 5,190,818, which are each incorporated herein by reference.

As shown, the back panel 14 is wider from side to side along the bottom fold line 16 and narrows toward its bottom edge 38. The back panel 14 may also be uniform in width from line 16 to edge 38. The closing flap 18 has a third upper surface 48, a third lower surface 50 and a top edge 52. Another adhesive area 54 is adhered to the upper surface 48 and positioned adjacent the top edge 52. The adhesive area 54 can be covered with a pattern of a standard remoist adhesive, a standard pressure sensitive adhesive or a latent adhesive. If a self-sticking adhesive is used, then a another pattern of a self-sticking adhesive is applied to a corresponding adhesive area 56 located on lower surface 34 of back panel 14 adjacent the bottom edge 38. The first left-side flap 22 and first right-side flap 26 have a respective fourth and fifth upper surface 58 and 60, a fourth and fifth lower surface 62 and 64, and a side edge 66 and 68. Each side flap 22 and 26 has a respective adhesive area 70 and 72, covered with a pattern of a self-sticking adhesive, on its lower surface 62 and 64 adjacent its side edge 66 and 68. As is described in greater detail hereafter, the adhesive pattern on each of the areas 70 and 72 is disposed so as to overlap, make contact and bond with a respective one of the adhesive patterns on areas 44 and 46 when the envelope sheet 10 is formed into an envelope 170 in accordance with the principles of the present invention.

One of the other types of latent adhesive can be used to bond together adhesive areas 44 and 46 to areas 70 and 72, respectively. If a heat seal type or encapsulated adhesive is used, instead of a self-sticking adhesive, then only one of the mating areas 44 and 70 and only one of the areas 46 and 72 need be covered with a pattern of the adhesive. Likewise, it is understood that only one of any two mating adhesive areas referred to herein need be covered with a latent adhesive pattern (such as the heat seal or encapsulated type) in order to practice the present invention. Even so, it may still be desirable to cover both mating areas with an adhesive pattern, regardless of the latent adhesive used, and such is also within the scope of the present invention.

Figure 2:
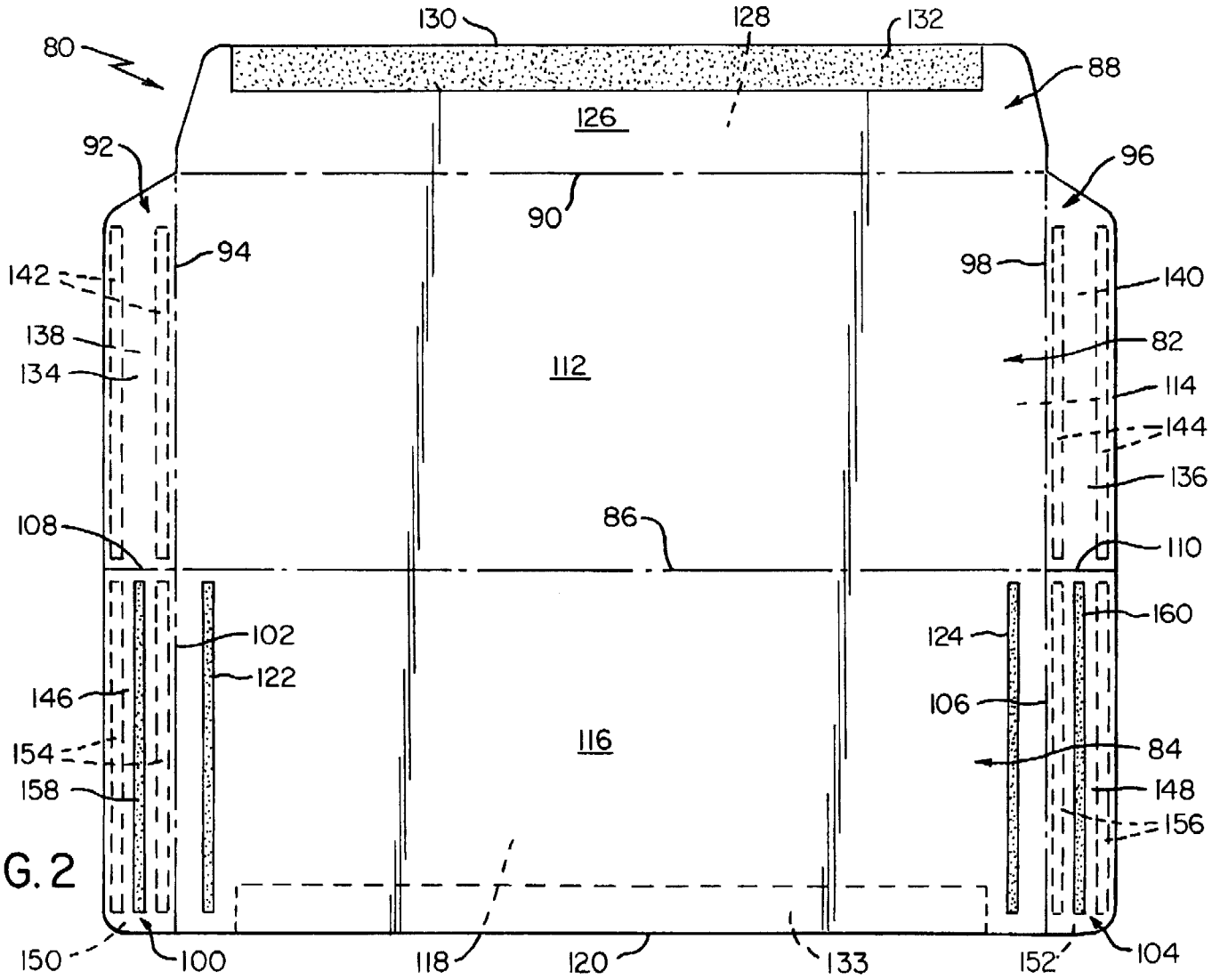
FIG. 2 is a top plan view of an alternative embodiment of the present envelope sheet.

Referring to FIG. 2, an alternative embodiment of an envelope sheet 80 according to the present invention includes a front panel 82 connected to a back panel 84 along a bottom fold line 86. The front panel 82 is also connected to a closing flap 88 along a top fold line 90, to a first left-side flap 92 along a first left-side fold line 94, and to a first right-side flap 96 along a first right-side fold line 98. The back panel 84 is connected to a second left-side flap 100 along a second left-side fold line 102 and is connected to a second right-side flap 104 along a second right-side fold line 106. The first and second left-side flaps 82 and 100 are connected along a left-side bottom fold line 108, and the first and second right-side flaps 96 and 104 are connected along a right-side bottom fold line 110. As with the previous embodiment, the fold lines of envelope sheet 80 may be perforated, creased or otherwise adapted to ensure folding therealong. The bottom fold lines 108 and 110 may each be a single perforation, completely separating their respective side flaps. Preferably, each fold line is formed by a plurality of perforations therealong.

The front panel 82 has a first upper surface 112 and a first lower surface 114. The back panel 84 has a second upper surface 116, a second lower surface 118 and a bottom edge 120. Two adhesive areas 122 and 124 are located on the upper surface 116, with each area 122 and 124 being adjacent one of the second fold lines 102 and 106, respectively. Each area 122 and 124 is covered with a pattern of a self-sticking adhesive. The closing flap 88 has a third upper surface 126, a third lower surface 128 and a top edge 130. Another adhesive area 132, covered by an adhesive pattern, is located on the upper surface 126 of closing flap 88 adjacent the top edge 130. As with the previous envelope sheet 10, the adhesive area 132 on closing flap 88 may be covered by a pattern of a standard remoist adhesive, a standard pressure sensitive adhesive or a latent adhesive. If a self-sticking adhesive is used, then another pattern of a self-sticking adhesive is applied to a corresponding adhesive area 133 on the lower surface 118 of back panel 84 adjacent the bottom edge 120. The adhesive areas 132 and 133 are positioned to overlap and bond together adhesively when the envelope sheet 80 is formed into an envelope, closed and sealed.

The first left-side flap 92 and first right-side flap 96 have a respective fourth and fifth upper surface 134 and 136 and a fourth and fifth lower surface 138 and 140, with an adhesive area 142 and 144, covered with a pattern of self-sticking adhesive, on the lower surfaces 138 and 140, respectively. The second left-side and right-side flaps 100 and 104 have a respective sixth and seventh upper surface 146 and 148 and a sixth and seventh lower surface 150 and 152. Each second side flap 100 and 104 has an adhesive area 154 and 156, covered with a pattern of self-sticking adhesive, on its lower surface 150 and 152, respectively, and an adhesive area 158 and 160, also covered with a pattern of self-sticking adhesive, on its upper surface 146 and 148, respectively.

It is preferable for each of the adhesive areas 142, 144, 154, and 156 to be covered by a pattern of two spaced and generally parallel strips of adhesive formed on either side of its respective side flap 92, 96, 100 and 104. By using two rather than just one glue line for the adhesive pattern on each adhesive area 142, 144, 154 and 156, corresponding side flaps can be more securely bonded to each other. In addition, by using double glue lines, a plurality of envelope sheets 80 may be stacked one on top of the other without the adhesive patterns on areas 154 and 156 of one envelope sheet 80 respectively contacting the adhesive patterns on the areas 158 and 160 of another envelope sheet 80. However, the present invention is not intended to be limited to any particular design for each adhesive pattern.

As described in detail below, the adhesive pattern on each of the areas 154 and 156 is disposed to overlap, make contact and adhesively bond with the corresponding adhesive pattern on the areas 142 and 144, when the envelope sheet 80 is formed into an envelope. Likewise, the adhesive pattern on each of the areas 158 and 160 is disposed to overlap, make contact and adhesively bond with the corresponding adhesive pattern on areas 122 and 124, when envelope sheet 80 is formed into an envelope. It should be understood by those skilled in the art that while the use of an adhesive area 122, 124, 158 and 160, covered with a latent adhesive, is preferred, it is not necessary in order to practice the present invention.

Referring to FIGS. 3*a–d*, a method of forming the envelope sheet 10 into a closed envelope 170 includes the steps of folding over the side flaps 22 and 26 onto the front panel 12 along their respective fold lines 24 and 28 until their upper surfaces 58 and 60 are adjacent to the upper surface 30 of front panel 12. The back panel 14 is then folded over onto the now folded side flaps 22 and 26 along the bottom fold line 16 until each adhesive pattern on areas 44 and 46 overlaps and contacts the corresponding adhesive pattern on areas 70 and 72, respectively. A sealing pressure is then applied between the back panel 14 and the side flaps 22 and 26 to activate and to bond together the adhesive patterns sandwiched therebetween. With its flap 18 open (see FIG. 3*c*), the resulting envelope 170 may be stuffed with any suitable insert (not shown) and then sealed closed. If the adhesive pattern used on area 54 is a remoist adhesive, envelope 170 may be sealed closed in a conventional manner by moistening adhesive 54, folding over the closing flap 18 onto the lower surface 36 of back panel 14 along the top fold line 20 until adhesive 54 contacts back panel 14. A sealing pressure is then applied between the back panel 14 and closing flap 18. When a self-sticking adhesive pattern is used on areas 54 and 56, a sealing pressure is still applied between the cover flap 18 and the back panel 14 to bond together the adhesive patterns sandwiched therebetween.

The method for forming envelope sheet 80 into an envelope (not shown) is similar to the method described above for forming envelope sheet 10 into envelope 170. With envelope sheet 80, both the first side flaps 92 and 96 and the second side flaps 100 and 104 are folded over, respectively, onto the front panel 82 and the back panel 84 along fold lines 94, 98 and 102, 106. The upper surfaces 134 and 136 of each first side flap 92 and 96 are brought adjacent to the upper surface 112 of front panel 82. The upper surface 146 and 148 of the second side flaps 100 and 104 are brought adjacent to the upper surface 116 of back panel 84 so that each adhesive pattern on areas 158 and 160 overlaps and contacts the corresponding adhesive pattern on areas 122 and 124, respectively. While preferable, the use of these adhesive patterns on areas 122, 124, 158 and 160 is not essential to this embodiment. The back panel 84 and second side flaps 100 and 104 are then folded over onto the front panel 82 along fold line 86 and lines 108 and 110 until each adhesive pattern on areas 154 and 156 overlaps and contacts the corresponding adhesive pattern on areas 142 and 144, respectively. A sealing pressure is then applied between the sides of the back panel 84 and those of the front panel 82 to activate and to bond together the adhesive patterns sandwiched therebetween. The resulting envelope is then closed and sealed in any one of the ways previously described for envelope 170.

Figure 4:
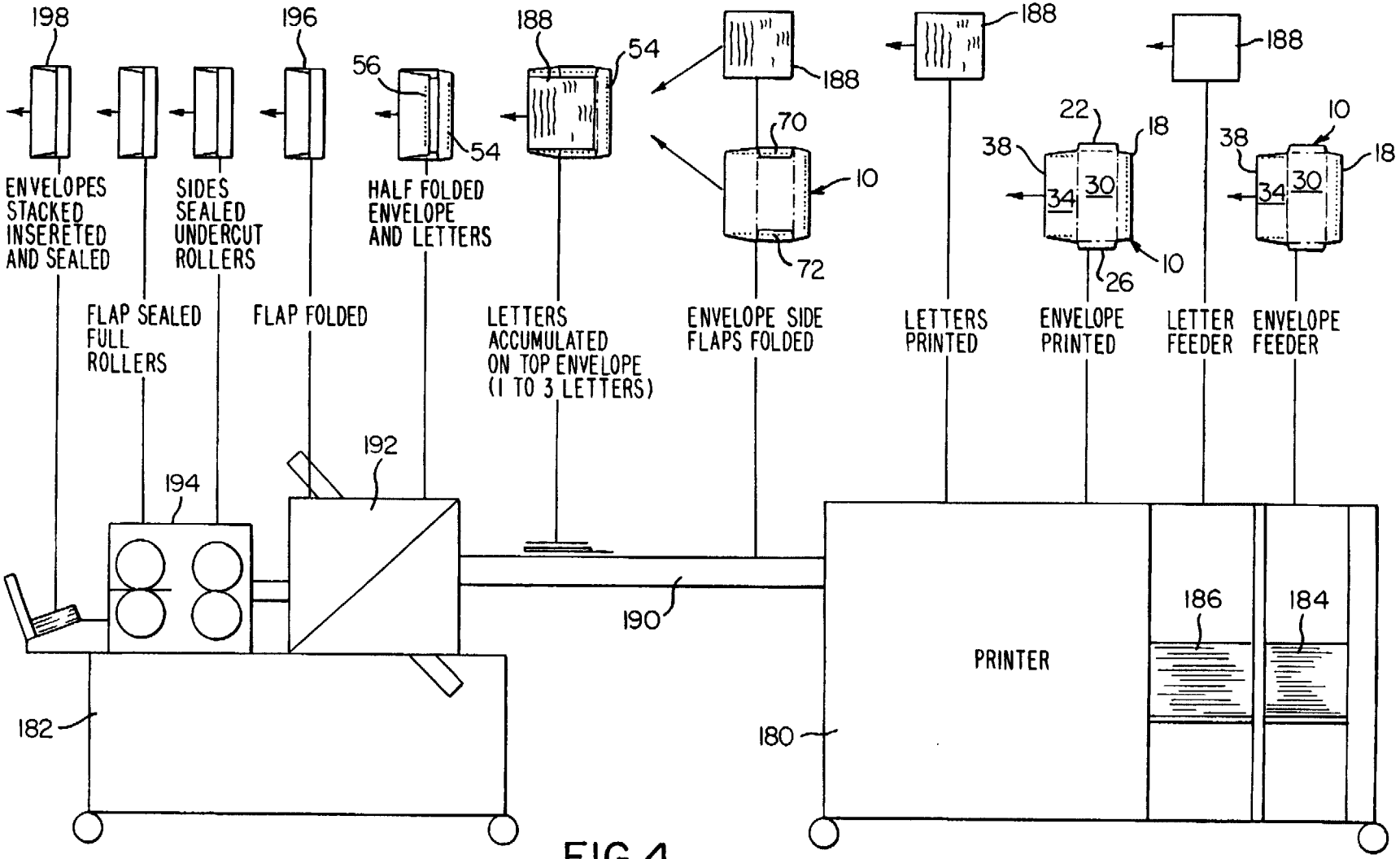
FIG. 4 is a diagrammatic view of one method of automatically stuffing an envelope according to the principles of the present invention.

Referring to FIG. 4, envelope sheets according to the present invention are particularly adapted for being printed with a high-speed separate sheet printer 180, for example, a separate sheet laser printer manufactured by Xerox, model no. 4135, and then formed into an envelope using high-speed separate sheet folding and pressure sealing equipment 182, for example, the SOFRAPLI F15-2R 250, manufactured by SOFRAPLI, located in Cachan Cedex, France. By way of example only, the following description shall refer to the forming of the envelope sheet 10 with self-sticking adhesive patterns on areas 54 and 56. By mounting the folding and sealing equipment 182 in line with the high speed printer 180, the envelope sheet 10 may be fed into the printer and a fully formed envelope may be delivered at the end of the line either with or without an insert stuffed therein. It is understood that the apparatus and method described as follows is not intended to be limited to being used with this or any other embodiment of the present envelope sheet.

The printer 180 includes a first automatic sheet feeder 184 for feeding a plurality of the envelope sheets 10 into the printer 180. Because they are substantially unfolded, the present envelope sheets can be fed into and printed in a printer 180 that is unable to receive and to print preformed envelopes. The envelope sheets 10 are piled one on top of the other in a stack before being fed into the printer 180. Such a stack of envelope sheets 10 should be fairly even in height to allow for consistent feeding into the printer 180. An uneven stack height could prevent proper feeding of the envelope sheets 10. The envelope sheets 10 stack evenly due to an even distribution of the adhesive patterns around the perimeter of each envelope sheet. Because its width remains substantially uniform over more of its length, the envelope sheet 80 is less likely to become misaligned when travelling through the printer 180 than the envelope sheet 10. The mailing address and any other desired indicia is printed on the lower surface and, if desired, on the upper surface of each envelope sheet 10. Preferably, the printer 180 also includes a second automatic sheet feeder 186 for feeding a stack of sheet inserts 188 into the printer 180. Each sheet insert 188 could comprise one or more sheets, such as a single or multiple page letter.

Printer 180 has a collator feature (not shown) for automatically disposing the sheet insert 188 on top of the upper surface of the envelope sheet 10 after the envelope sheet is printed. Each sheet insert 188 may be preprinted before being fed into the printer 180 or printed in printer 180 before being disposed on the envelope sheet 10. The sheet insert 188 is preferably of an effective size to fit between the side flaps 22 and 26 of the envelope sheet 10 while in their fully folded condition (see FIG. 3(*b*)). The sheet insert may be prefolded to obtain this effective size before being disposed onto the envelope sheet in order to lie between the side flaps 22 and 26. Each envelope sheet 10 with a sheet insert 188 thereon is moved from the printer 180 to the equipment 182 by a conveyer 190. Any convenient commercially available belt conveyer can be used. The conveyer 190 is configured so that the side flaps 22 and 26 are automatically folded over and onto the front panel 12 as the sheet envelope 10 and insert 188 travel over conveyer 190 from the printer 180. The insert 188 is preferably disposed onto the envelope sheet 10 before the side flaps 22 and 26 are folded over.

Figure 3A:
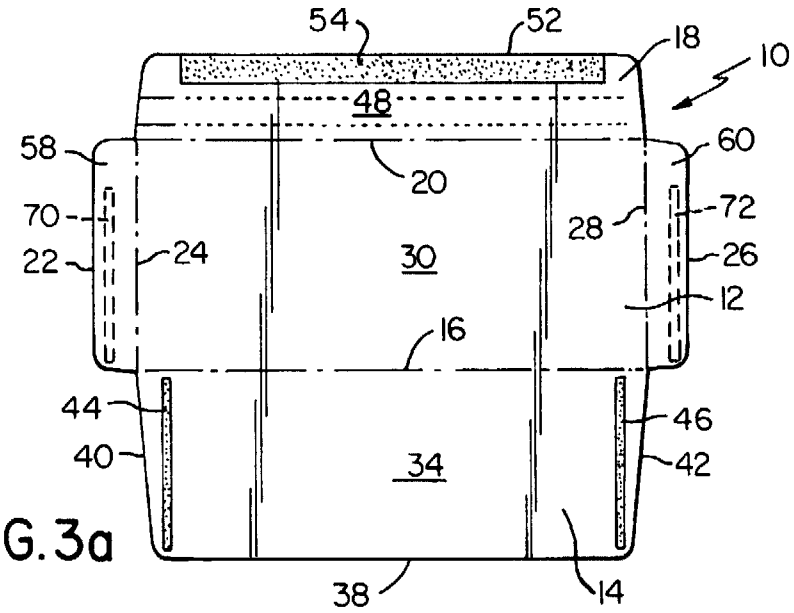
FIG. 3(*a*)–FIG. 3(*d*) are top views of the envelope sheet of Fig.1 in various stages of being formed into a closed envelope.
Figure 3B:
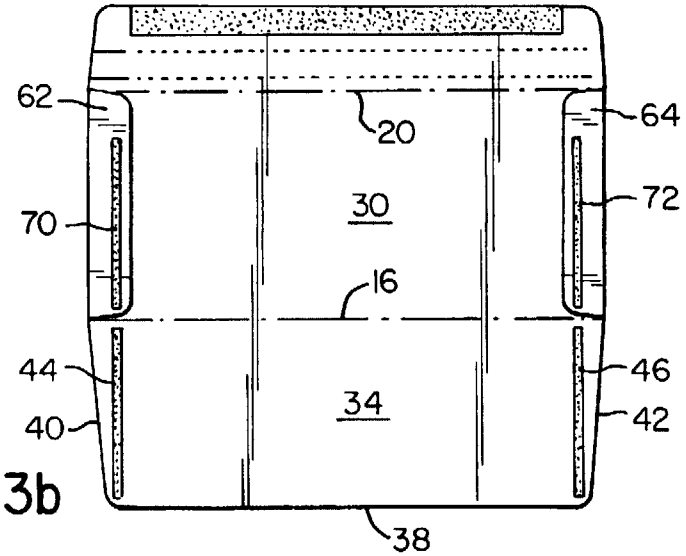
Figure 3C:
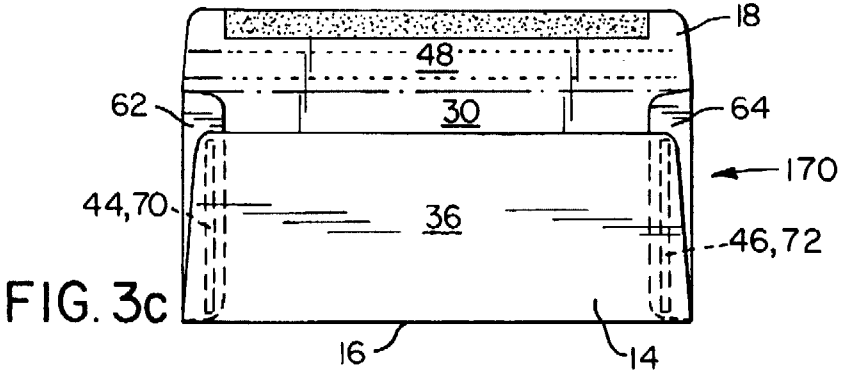
Figure 3D:
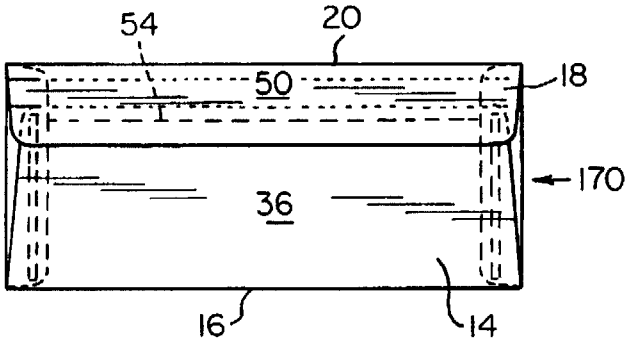

The equipment 182 includes a sheet folding machine 192 and a pressure sealing machine 194. The folding machine 192 receives each envelope sheet 10 and insert 188 combination folding the back panel 14 over onto the front panel 12 along fold line 16 (see FIG. 3*c*) and sandwiching the insert 188 therebetween. The closing flap 18 is then folded over along fold line 20, as shown in FIG. 3*d*, to form a fully folded, but unsealed, envelope 196 stuffed with insert 188. The unsealed envelope 196 and insert 188 are then conveyed to the pressure sealing machine 194 where rollers automatically apply a pressure (see previous description) to activate and to bond together adhesively the side flap adhesive patterns on areas 70 and 72 to the back panel adhesive patterns on areas 44 and 46, respectively. Pressure sealing machine 194 also automatically applies a sealing pressure as previously described to activate and to bond together adhesively the closing flap adhesive pattern on area 54 and the back panel adhesive pattern on area 56, to form a fully sealed envelope 198 stuffed with insert 188 and ready for posting and mailing.

The above process and apparatus can be modified in numerous ways without departing from the principles of the present invention. If the latent adhesive used is the heat seal type, a heating element will have to be provided in the pressure sealing machine 194 to heat the adhesive directly before or while the rollers apply the sealing pressure. In addition, the stuffing of insert 188 can be performed after the envelope sheet 10 is printed and formed into an open envelope, such as that shown in FIG. 3*c*, using conventional envelope stuffing apparatus and methods. With such a modified process, the closing flap 18 is folded over and sealed closed after the insert 188 is stuffed into the envelope by the conventional means. For example, a remoist adhesive can be used for adhesive pattern 54 and the closing flap 18 can be folded over and sealed closed manually. However, it is preferred that such a secondary envelope stuffing operation be eliminated.

From the above disclosure of the general principles of the present invention and the preceding detailed description, those skilled in this art will readily comprehend the various modifications to which the present invention is susceptible. Therefore, the scope of the invention should be limited only by the following claims and equivalents thereof.

What is claimed is:

1. A method of automatically stuffing an envelope, said method comprising the steps of:

providing a plurality of envelope sheets, each envelope sheet having a front panel connected to a back panel along a bottom fold line, to a closing flap along a top fold line, to a left-side flap along a left-side fold line and to a right-side flap along a right-side fold line, each envelope sheet further having a first pattern of pressure sensitive adhesive provided on at least one of a location on the left-side flap and a location opposite the left-side flap, and a second pattern of pressure sensitive adhesive provided on at least one of a location on the right-side flap and a location opposite the right-side flap;

providing a plurality of inserts, each insert being effectively smaller in area then each envelope sheet;

automatically feeding one of said envelope sheets into a high-speed separate sheet printer;

automatically printing in a non-impact manner on at least one surface of the front panel before the envelope sheet is formed into an envelope;

automatically disposing at least one insert on top of each envelope sheet before the envelope sheet is formed into an envelope;

after the envelope sheet printing step, automatically folding over the left-side flap and the right-side flap along the left-side fold line and along the right-side fold line, respectively, onto the front panel;

automatically folding over the back panel along the bottom fold line and onto the left-side flap and the right-side flap, thereby sandwiching at least one insert between the front and back panels; and automatically activating said first pattern of adhesive and said second pattern of adhesive to form an envelope stuffed with at least one insert.

2. The method of claim 1, further comprising the steps of:

automatically feeding a sheet insert from a stack of sheet inserts into the high-speed separate sheet printer; and automatically printing on at least one surface of each sheet insert before the sheet insert is disposed on top of an envelope sheet.

3. The method of claim 1, further comprising the steps of:

automatically folding over the closing flap along the top fold line onto the back panel after the envelope is formed; and automatically activating a pattern of adhesive sandwiched between the closing flap and the back panel.

4. A method of automatically stuffing an envelope as claimed in claim 1, wherein said pressure sensitive adhesive is selected from the group consisting of a latent adhesive, a self-sticking adhesive, and an encapsulated adhesive.

5. A method of automatically stuffing an envelope as claimed in claim 1, wherein said pressure sensitive adhesive comprises a self-sticking adhesive, wherein said first pattern of pressure sensitive adhesive is provided on the left-side flap and opposite the left-side flap, and wherein said second pattern of pressure sensitive adhesive is provided on the right-side flap and opposite the right-side flap.

6. A method of forming a printed envelope from an envelope sheet, said method comprising the steps of:

providing a plurality of envelope sheets, each envelope sheet having a front panel connected to a back panel along a bottom fold line, to a closing flap along a top fold line, to a left-side flap along a left-side fold line and to a right-side flap along a right-side fold line, each envelope sheet further having a first pattern of pressure sensitive adhesive provided on at least one of a location on the left-side flap and a location opposite the left-side flap, and a second pattern of pressure sensitive adhesive provided on at least one of a location on the right-side flap and a location opposite the right-side flap;

automatically feeding one of said envelope sheets into a high-speed separate sheet printer;

automatically printing in a non-impact manner on at least one surface of the front panel before the envelope sheet is formed into an envelope;

after the envelope sheet printing step, automatically folding over the left-side flap and the right-side flap along the left-side fold line and along the right-side fold line, respectively, and onto the front panel;

automatically folding over the back panel along the bottom fold line and onto the left-side flap and the right-side flap; and automatically activating said first pattern of adhesive and said second pattern of adhesive to form an envelope.

7. A method of forming a printed envelope as claimed in claim 6 wherein said pressure sensitive adhesive is selected from the group consisting of a latent adhesive, a self-sticking adhesive, and an encapsulated adhesive.

8. A method of forming a printed envelope as claimed in claim 6 wherein said pressure sensitive adhesive comprises a self-sticking adhesive, wherein said first pattern of pressure sensitive adhesive is provided on the left-side flap and opposite the left-side flap, and wherein said second pattern of pressure sensitive adhesive is provided on the right-side flap and opposite the right-side flap.

9. An apparatus for automatically printing and forming an envelope from an envelope sheet, said apparatus comprising:

a high-speed separate sheet non-impact printer having a first automatic sheet feeder for feeding a stack of envelope sheets into said printer;

a plurality of envelope sheets provided in said first automatic sheet feeder, each envelope sheet having a front panel connected to a back panel along a bottom fold line, to a closing flap along a top fold line, to a left-side flap along a left-side fold line and to a right-side flap along a right-side fold line, each envelope sheet further having a first pattern of pressure sensitive adhesive provided on at least one of a location on the left-side flap and a location opposite the left-side flap, and a second pattern of pressure sensitive adhesive provided on at least one of a location on the, right-side flag and a location opposite the right-side flap;

a folding machine for folding each envelope sheet into a folded envelope;

a sealing machine for applying a sealing pressure between folded portions of the folded envelope to activate said-first adhesive pattern and said second adhesive pattern; and a conveyer system interfacing the printer with the folding machine and the sealing machine for moving each envelope sheet from the printer to the folding machine and the sealing machine.

10. The apparatus of claim 9, further comprising:

disposing means for automatically disposing at least one insert on each envelope sheet after each envelope sheet is printed, said folding machine being operatively adapted for folding each envelope sheet into a folded envelope stuffed with at least one insert, and said conveyer system being operatively adapted for moving each envelope sheet and the corresponding insert from the printer to the folding machine and the sealing machine.

11. The apparatus of claim 10, said printer having a second automatic sheet feeder for feeding a stack of sheet inserts into said printer, and said disposing means being a collator feature of said printer capable of automatically disposing at least one sheet insert on each envelope sheet after each envelope sheet is printed.

12. The apparatus of claim 10, said folding machine being operatively adapted to automatically close each folded envelope with the corresponding insert therein, and said sealing machine being operatively adapted to automatically seal each stuffed envelope closed.

13. An apparatus for automatically printing and forming an envelope from an envelope sheet as claimed in claim 9, wherein said pressure sensitive adhesive is selected from the group consisting of a latent adhesive, a self-sticking adhesive, and an encapsulated adhesive.

14. An apparatus for automatically printing and forming an envelope from an envelope sheet as claimed in claim 9, wherein said pressure sensitive adhesive comprises a self-sticking adhesive, wherein said first pattern of pressure sensitive adhesive is provided on the left-side flap and opposite the left-side flap, and wherein said second pattern of pressure sensitive adhesive is provided on the right-side flap and opposite the right-side flap.

* * * * *

UNITED STATES PATENT AND TRADEMARK OFFICE

CERTIFICATE OF CORRECTION

PATENT NO. : 5,794,409

DATED : August 18, 1998

INVENTOR(S) :
Walter M. Akridge; David E. Washburn; John A. Moore, Jr.

It is certified that error appears in the above-identified patent and that said Letters Patent is hereby corrected as shown below:

Column 10, Claim 9, Line 66 "on the, right-side" should be - - on the right-side- - .

Column 10, Claim 9, Line 67 "flag and a location" should be - -flap and a location- -.

Column 11, Claim 9, Line 5 "said-first adhesive" should be - -said first adhesive- -.

Signed and Sealed this

Eighth Day of December, 1998

Bruce Lehman

*Attest:*

BRUCE LEHMAN

*Attesting Officer*

*Commissioner of Patents and Trademarks*